United States Patent [19]

Watanabe

[11] 4,157,049

[45] Jun. 5, 1979

[54] ORGAN PERFORMANCE SUPPORTING DEVICE

[75] Inventor: Hironori Watanabe, Hamamatsu, Japan

[73] Assignee: Kabushiki Kaisha Kawai Gakki Setsakusho, Hammatsu, Japan

[21] Appl. No.: 846,515

[22] Filed: Oct. 28, 1977

[51] Int. Cl.[2] ..... G10H 1/02

[52] U.S. Cl. ..... 84/1.24; 84/1.01; 84/1.03

[58] Field of Search ..... 84/1.01, 1.03, 1.24, 84/DIG. 22, DIG. 16, 1.11, 1.12, 1.19, 1.21, 331, 337

[56] References Cited

U.S. PATENT DOCUMENTS

| | | | |
|---|---|---|---|
| 3,939,750 | 2/1976 | Inoue | 84/1.01 |
| 3,955,459 | 5/1976 | Mochida | 84/1.03 |
| 4,046,047 | 9/1977 | Roberts | 84/1.01 |
| 4,072,078 | 2/1978 | Shallenberger | 84/DIG. 22 |
| 4,106,383 | 8/1978 | Dittmar | 84/1.01 |

*Primary Examiner*—J. V. Truhe
*Assistant Examiner*—William L. Feeney

[57] ABSTRACT

An organ performance supporting device which has means for detecting ON signals of actuating switches of combination units to provide control code signals, means for setting signals indicating the individual operative states of the switches by the switch-ON detecting signals, a read-only memory for storing coded control signals necessary for the presetting and selection of registrations, the coded control signals being selectively read out in reply to the detected control code signals, a combination registration memory composed of a writable memory and a read-only memory, the combination registration memory storing registrations required by the combination unit and selectively read out in reply to the detected control code signals, a register supplied with a signal from a stop switch and reading out the writable and read-only memories in a predetermined operative state to store the state of the combination unit and the ON-OFF state of the stop switch, a register for storing the registration output from each combination unit for synchronization with an external system, and means for indicating the state of each combination unit and the ON-OFF state of the stop switch.

5 Claims, 14 Drawing Figures

MA. CLOCK
SW.
SW.-ON DET. AND ENCODER
CTR.
MEMORY AD-DRESS DECODER
ROM
DECODER AND WRITE CONT. CKT.
S Q̄ R
INDICAT-ING UNIT
STOP SW. (41)
ON-OFF DET. (42)
STOP REG. (43,44)
REGISTRA-TION MEMO-RY (52,53)
OUTPUT REG. (45,46)
MEMORY ADDRESS DECODER (51)
OUTPUT 1
OUTPUT 2
OUTPUT 3
CRESCENDO REGISTRA-TION MEMORY
ADDRESS DECODER
CRESCENDO SWITCH

TONE AND EFFECT TABLET

ORGAN PERFORMANCE SUPPORTING DEVICE

BACKGROUND OF THE INVENTION

1. Field of the Invention

This invention relates to a performance supporting device for an organ which has various tone and effect switches for each keyboard of the organ.

2. Description of the Prior Art

Generally, in a pipe organ, an electronic organ, etc., there are provided for each keyboard pluralities of tone and effect switches usually called "stop", "stop table" or "draw knob". As a tune is played, registrations by these tablets are changed to produce various performance effects on the tune being played.

To rapidly provide such performance effects, pipe organs and the like have employed, as subsidiaries thereto, "combination" and "crescendo" mechanisms from olden times. The combination device is designed so that some lines of registrations preset by a player before his playing can be selectively produced as the playing of a tune proceeds. This device is usually added to large-sized electronic organs and the like.

In the case of the crescendo device, some steps of registrations are decided at the stage of manufacturing an organ and the number of tones sounded are successively increased by stepping on a crescendo pedal more deeply. The crescendo device is usually employed in a large-sized electronic organ commonly referred to as the church model.

In a typical combination device heretofore employed, switches are provided corresponding to tone and effect tablets for presetting registrations and are selectively actuated to perform the combination function. Accordingly, in this case, the number of switches necessary for presetting is (the number of tone and effect tablets to be preset)×(the number of lines of registrations) and the number of switches used increases with an increase in the number of tones to be sounded. For example, if five registration lines to be preset are provided in the case where each of swell, great and pedal keyboards has twelve tone and effect tablets, the number of switches required is $(12+12+12)5=180$. Further, a method of presetting registrations in holding relays from the tablets has also been employed. Also, in this case, however, reduction of mechanical parts is difficult, presenting a problem in the design of organs.

SUMMARY OF THE INVENTION

This invention is to provide a performance subsidiary device for organs which employs a digital control system enabling the use of LSIs and which minimizes mechanical parts to provide for enhanced reliability in operation.

To achieve the abovesaid objective, the device of this invention comprises means for detecting ON signals of actuating switches of combination and like units to provide control code signals, means for setting signals indicating the individual operative states of the switches by the switch-ON detecting signals, a read-only memory for storing coded control signals for the presetting and selection of registrations, the coded control signals being selectively read out in reply to the detected control code signals, a combination registration memory composed of a writable memory and a read-only memory, the combination registration memory storing registrations required by the combination unit and selectively read out in reply to the detected control code signals, a register supplied with a signal from a stop switch and reading out the writable and read-only memories in a predetermined operative state to store the state of the combination unit and the ON-OFF state of the stop switch, a register for storing the registration output from each combination unit for synchronization with an external system, and means for indicating the state of each combination unit and the ON-OFF state of the stop switch.

DESCRIPTION OF THE PREFERRED EMBODIMENTS

Figure 1:
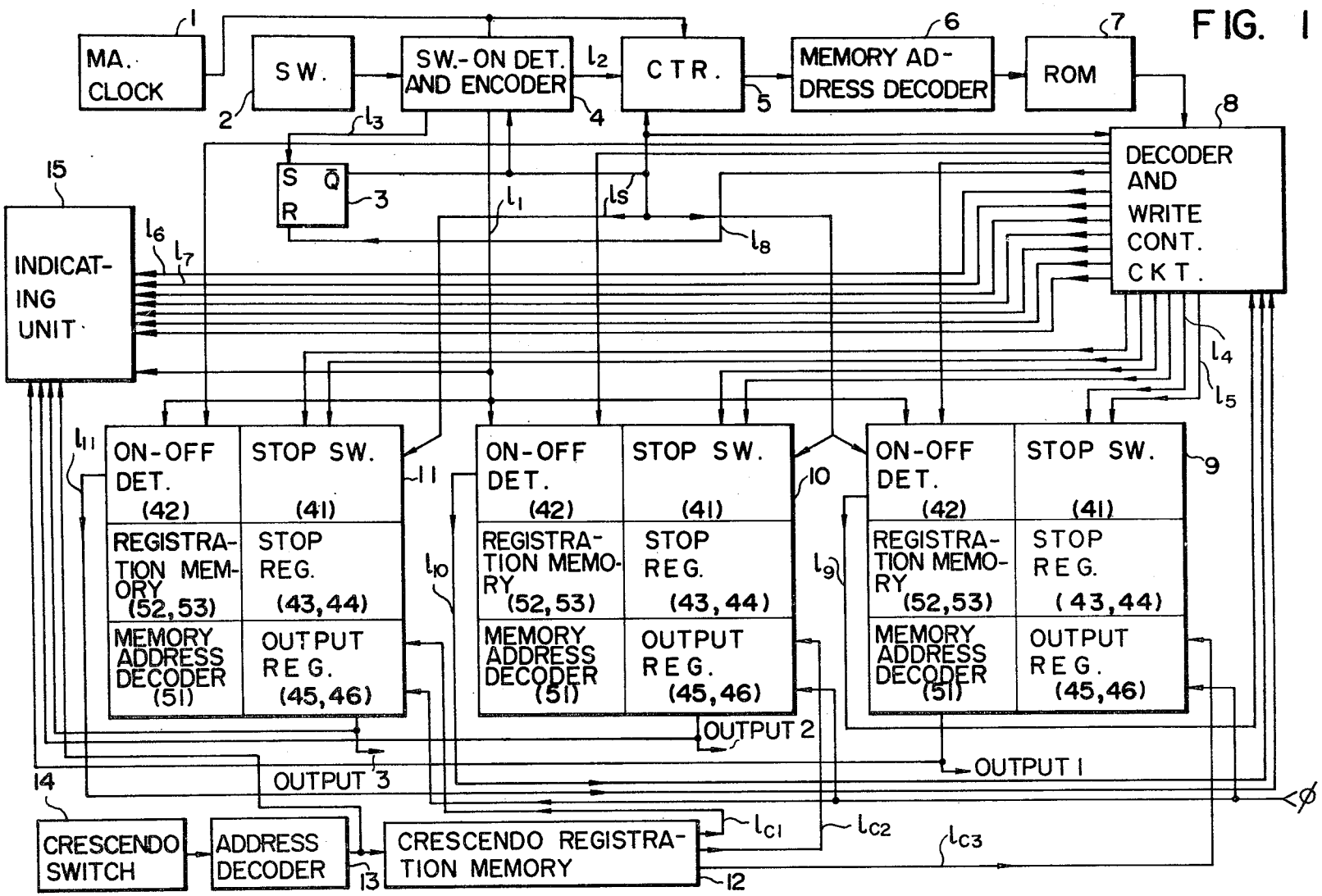
FIG. 1 is an explanatory diagram illustrating an embodiment of this invention.

FIG. 1 illustrates in block form the structure of an embodiment of this invention. The organ performance supporting device shown in FIG. 1 is a system which has swell, great and pedal keyboards and includes combination and crescendo units, each having pluralities of tone and effect tablets corresponding to the keyboards. A master clock 1 is a fundamental clock for controlling the present system, and is required to be high in frequency to such an extent as not to hinder organ performances. The frequency of this master clock 1 is preferred to be, for instance, 100 KHz or so. A switch unit 2 comprises general, swell, great and pedal combination designating switches, a full organ designating switch for presetting a representative registration in a fixed memory and selecting the registration with a one-touch operation, a cancel switch for turning OFF all the tone and effect tablets and a memory switch used for presetting registrations. These switches are non-locking single-pole switches which can be formed simple in mechanical structure.

An ON signal from the switch unit 2 is detected by a switch-ON detector and encoder 4 to provide a control signal corresponding to the detected signal, setting a status flip-flop 3 via line $l_3$. The $\overline{Q}$ output from the status flip-flop 3 is applied via a line $l_s$ to the switch-ON detector and encoder 4 to stop its operation. At this time, the switch-ON detector and encoder 4 provides control codes (a preset signal and memory area assign code) via a line $l_2$ to a counter 5 and assigns a registration memory address corresponding to the selected switch via a line $l_1$. The counter 5 is started by a counter start signal from the $\overline{Q}$ output of the status flip-flop 3 to apply the above-said control codes via a memory address decoder 6 to a read-only memory 7 to read out its content. The above-said status flip-flop 3 provides two operative states of the device of this invention: a first series of operations for the detection of an ON signal from the switch unit 2 and a second series of operations started by the switch-ON detection, that is, presetting, reading out of registration, etc. For the second operations, the read-only memory 7 is read out. The read-only memory 7 has stored therein coded control signals for the second series of operations to provide a certain control program. In the program for the second operations, there are set presetting of the registration of the combination units 9, 10 and 11 of the swell, great and pedal keyboards, reading out of the preset registration, a control of an indicating unit 15, for example, assignment of an indicator lamp, and the generation of an end signal indicating the completion of the second operations.

The control codes read out of the read-only memory 7 are decoded by a decoder and write control circuit 8 to provide control signals and the timing for input of the control signals to combination units 9, 10 and 11 is set up by an R/W flip-flop. The control signals are sent to the combination units 9, 10 and 11 of the swell, great and pedal keyboards which are capable of presetting the tone and effect tablets associated with the keybords, respectively. As illustrated in FIG. 1, the combination units 9, 10 and 11 are each composed of a stop switch (41), a stop register (43, 44), an ON-OFF detector (42), a registration memory (52, 53), a memory address decoder (51) and an output register (45, 46). Th parenthesized numerals are those marked in the detailed diagrams described later. The stop switch (41) is a non-lock switch as is the case with the switches in switch unit 2. The ON-OFF state of the stop switch (41) is detected by the ON-OFF detector (42). The stop register (43, 44) write therein the registration from the registration memory (52, 53) and, further, it is turned ON and OFF directly by the stop switch (41) to store various tones and effects. The stop register (43, 44) is also used during presetting and its output is applied to the data input of the registration memory (52, 53). The registration memory (52, 53) is composed of a random access memory having a general combination memory area and sub-combination memory areas of the swell, great and pedal keyboards and a read-only memory having stored therein a full organ registration. The memory address decoder 51 corresponds to the registration memory (52, 53). The output register (45,46) provides the logical sums of the output from a crescendo pedal described later on and the output from the stop register (43, 44) corresponding to the tone and effect selected, and retains the immediately preceding registration in the case of synchronization with an external system.

Now, let it be assumed that the swell combination assigning switch of the switch unit 2 is turned ON. A control signal is provided on a line $l_4$ to clear the stop register (43,44) of the swell combination unit 9. At this time, since an address is already sent via the line $l_1$ to the registration memory (52, 53) from the switch-ON detector and encoder 4, the registration corresponding to the address is written in the stop register (43, 44) by a set signal on a line $l_5$. A signal for clearing a display register of the swell combination keyboard is provided on a line $l_6$ to clear a stop register of the indicating unit 15. Next, a signal is provided on a line $l_7$ for setting the control code in the line $l_1$ from the switch-ON detector and encoder 4 in the register corresponding to the control code, lighting the corresponding indicator lamp of the indicating unit 15. Then, an end signal indicating the completion of the series of operations is provided on a line $l_8$ and the switch-ON decoder and encoder 4 resumes the first operation of the switch-ON detection and the counter 5 is reset.

The ON-OFF detector (42) of each combination unit detects turning ON and OFF of the stop switch (41). Upon switching of the stop switch (41) after turning ON of the memory switch, a signal for cancelling the operation resulting from turning ON of the memory switch is applied to the decoder and write control circuit 8 through each of lines $l_9$, $l_{10}$ and $l_{11}$ from each ON-OFF detector (42). The output register (45, 46) of each combination unit is supplied with a fundamental clock $\phi$ of an external system to provide synchronization. A signal from a crescendo switch 14, which is turned ON and OFF by a crescendo pedal, is decoded by an address decoder 13 and is displayed on the indicating unit 15. At the same time, the output from the address decoder 13 is fed to a crescendo registration memory 12 formed with a read-only memory to selectively read it out, providing via lines $l_{c1}$, $l_{c2}$ and $l_{c3}$ pedal, great and swell registration outputs to the output registers (45, 46) of the combination units 9, 10 and 11, respectively. Outputs 1, 2 and 3 are derived from these output registers (45, 46) and, at the same time, these outputs are applied to the indicating unit 15. The indicating unit 15 is adapted for lamp indication so as to minimize mechanical parts of the device, and provides an ON-OFF indication of each tone from the decoder and write control circuit 8, an indication of the designated combination output from each combination unit and a status indication of the crescendo pedal.

Figure 2:
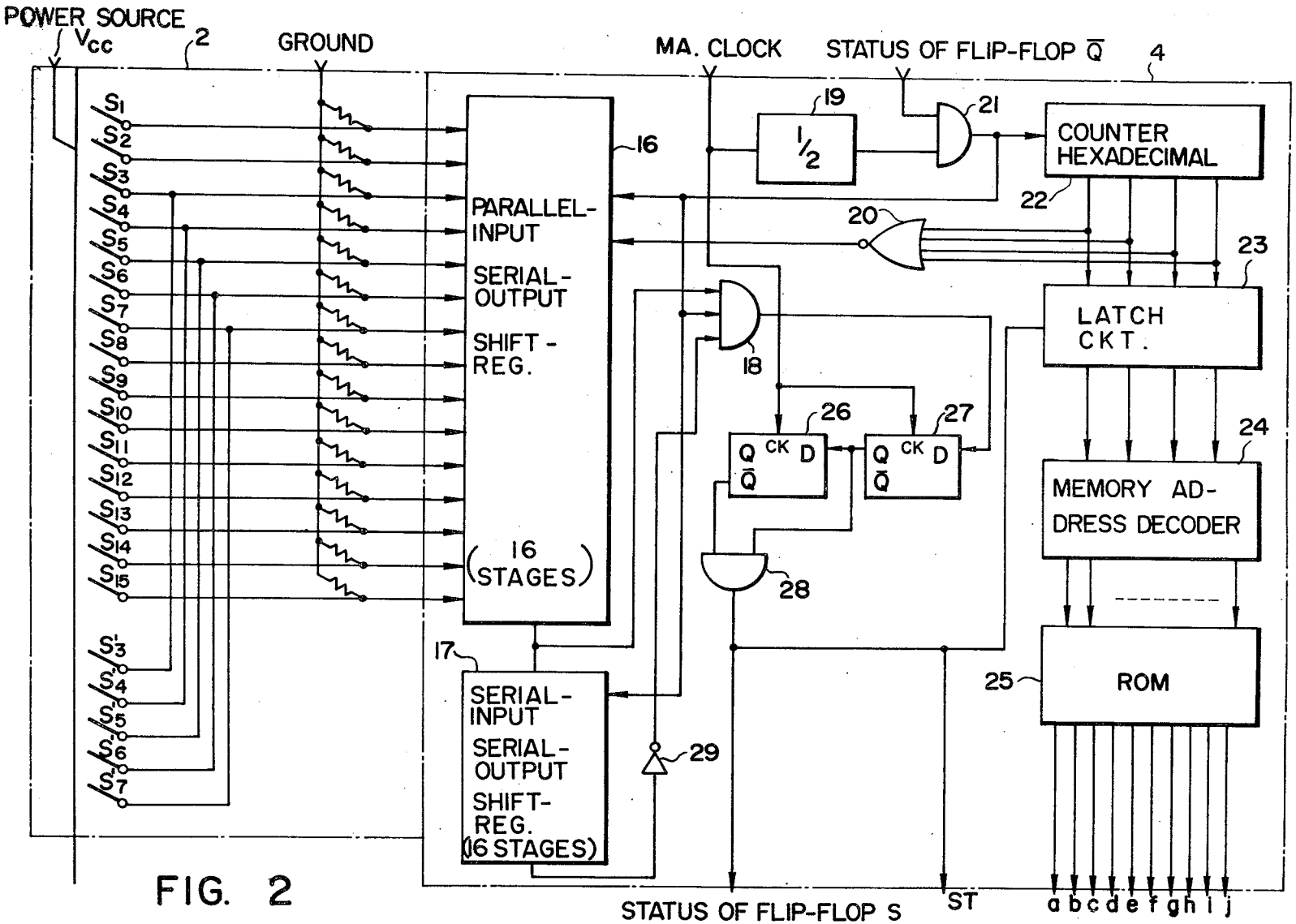
FIG. 2 shows details of the switch unit, the switch-ON detector and encoder.

FIG. 2 shows in detail the switch unit 2 and the switch-ON detector and encoder 4 used in the FIG. 1 embodiment.

As depicted in FIG. 2, the switch unit 2 includes a variety of switches such, for example, as a cancel switch $S_1$, a memory switch $S_2$, a full organ switch $S_3$, combination switches, that is, general, swell, great and pedal switches ($S_4$ to $S_7$), ($S_8$ to $S_{10}$), ($S_{11}$ to $S_{13}$) and ($S_{14}$ and $S_{15}$), and switches ($S_3'$ to $S_7'$) which are actuated by feet. The ON signals of these switches are applied to the switch-ON detector and encoder 4 indicated by the one-dot chain line. A shift register 16 is a parallel-input serial-output shift register which shifts in synchronism with a counter 22. When the count value of the counter 22 is "0000", the shift register 16 performs the parallel-input operation to write therein the states of the switches in reply to the output from a NOR circuit 20, and outputs the stored data in serial at the other timing. In synchronism with this, a serial-input serial-output shift register 17 serially writes therein the output from the shift register 16 and, at the same time, serially outputs the already stored content. The shift registers 16 and 17 are constructed to have the same number of stages and sequentially output the states $t_n$ and $t_{n+1}$ (n: the timing at which the shift registers write therein the states of the switches in parallel) for the respective switches.

By the comparison of these two timings, the ON state of each switch is detected. That is, the states of the switches can be sequentially discriminated depending upon the output conditions of the shift registers 16 and 17, marked with * as shown in the in the following Table 1.

Table 1

| $t_n$ Output from 16 | $t_n-1$ Output from 17 | States of switches |
|---|---|---|
| 0 | 0 | Held in the OFF state |
| 0 | 1 | Turned OFF |
| 1 | 0 | Turned ON . . .* |
| 1 | 1 | Held in the ON state |

In FIG. 2, the output from the shift register 16 and the output from the shift register 17, inverted by an inverter 29, are applied to an AND circuit 18, thereby to detect the condition marked with *. Upon detection of the ON state, a change in the output of the AND circuit 18 from "0" to "1" is detected by an edge detector composed of D type flip-flops 26 and 27, each generating a one-shot pulse with the edge, and an AND circuit 28. With the one-shot pulse, the count value of a counter 22 is written in a latch circuit 23. Since the counter 22 perform its counting operation in synchronism with the operations of the shift registers 16 and 17, the count value has one to one correspondence to the respective switches. Accordingly, the latch circuit 23 stores therein the codes corresponding to the switch being turned ON.

At this time, the status flip-flop 3 is set by the abovesaid one-shot pulse to provide the $\overline{Q}$ output, which is applied to an AND circuit 21 to stop the operations of the counter 22 and the shift registers 16 and 17. Upon resetting of the status flip-flop 3 after the completion of the second operation in the present system, the first operation for the switch-ON detection is resumed.

On the other hand, the codes stored in the latch circuit 23 are applied to a read-only memory 25 through a memory address decoder 24, by which the codes are converted to control codes, that is, codes assigning the registration memory address and the control signal memory area corresponding to the switch turned ON. Namely, six high-order bits are used as control signal memory area assigning codes (a, b, c, d, e, f) and four low-order bits as registration memory address assigning codes (g, h, i, j).

Figure 3:
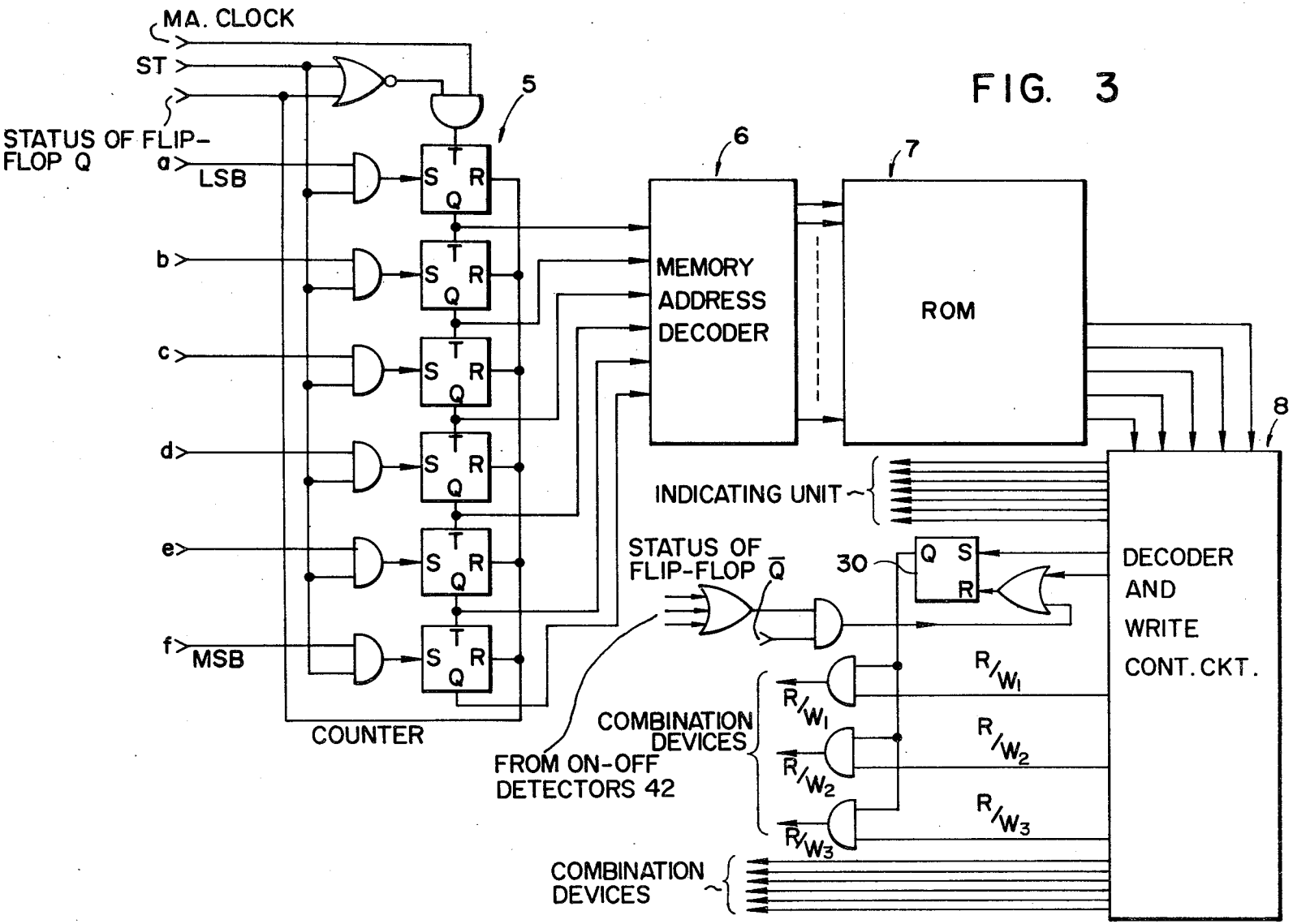
FIG. 3 shows details of the counter, the memory address decoder, the read only memory and the decoder and write control circuit.

FIG. 3 illustrates in detail the counter 5, the memory address decoder 6, the read-only memory 7 and the decoder and write control circuit 8 employed in the FIG. 1 embodiment.

The counter 5 presets the control signal memory area assigning codes a to f in T flip-flops through AND circuits with the one-shot pulse ST produced by the switch-ON and encoder 4 shown in FIG. 2, and adds an increment (+n, −n=1, 2, . . . ) to the preset value by the master clock when the one-shot pulse ST and the status flip-flop output $\overline{Q}$ become "0". Accordingly, control codes are sequentially read out from the read-only memory 7 through the memory address decoder 6 corresponding to the abovesaid count value.

The control codes thus read out of the read-only memory 7 are decoded by the decoder and write control circuit 8 to provide various control signals, which are applied to the indicating unit 15 and the combination units 9, 10 and 11. A flip-flop 30 is set by a write set signal upon turning ON of the memory switch to temporarily store it, and is reset by a signal of the ON-OFF detector (42) from each of the combination units 9, 10 and 11 when the present system is in its first operative state. The output from the flip-flop 30 controls write signals $R/W_1$, $R/W_2$ and $R/W_3$ through AND circuits. That is, when the flip-flop 30 is not set, the write signals from the read-only memory 7 are inhibited. In other words, the flip-flop 30 is a status flip-flop which discriminates two cycles of registration preset and registration read from each other.

Figure 4:
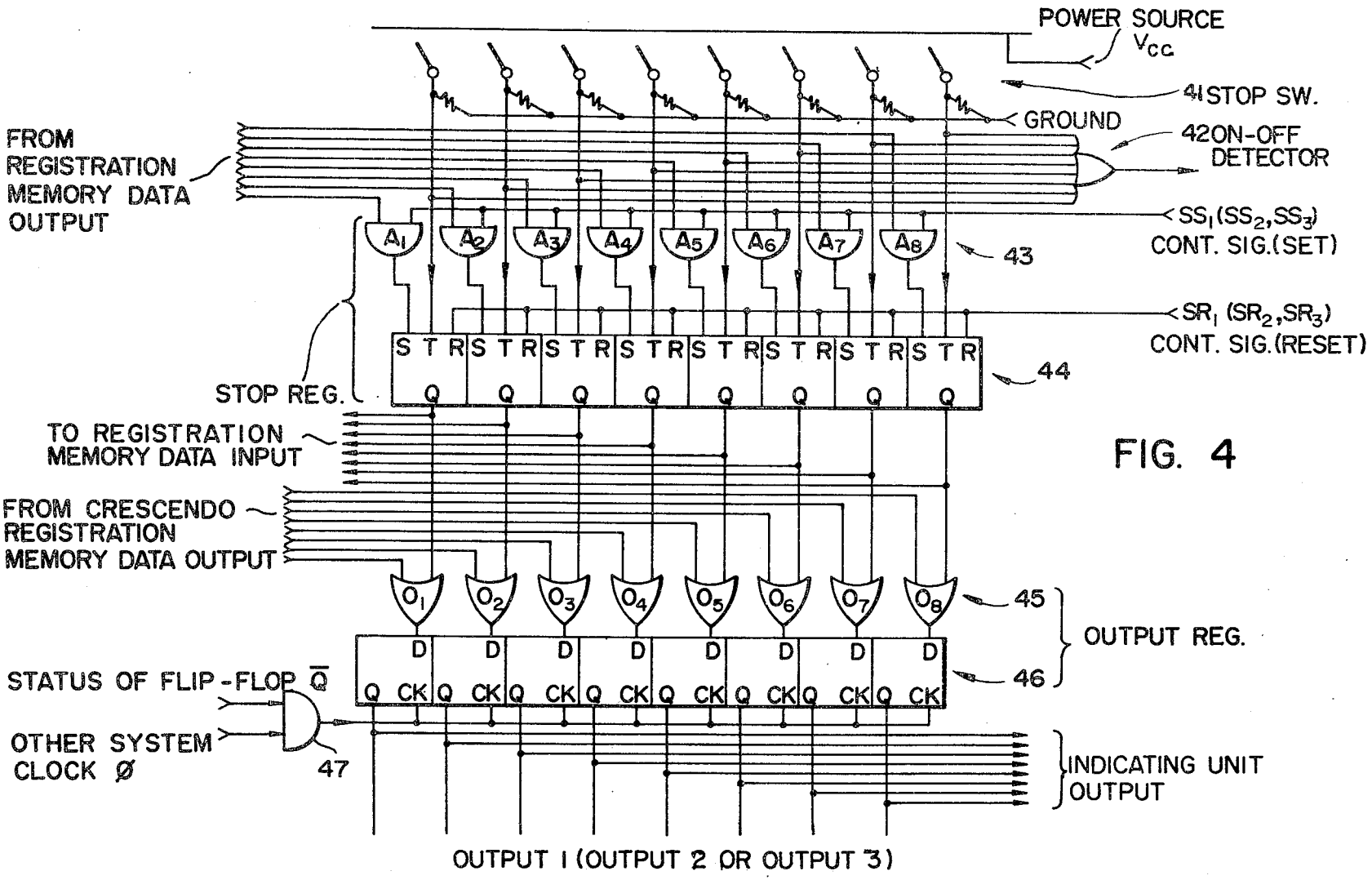
FIG. 4 shows details of the ON-OFF detector, the stop switch, the stop register and the output register of each of the combination units.

FIG. 4 shows in detail the ON-OFF detector, the stop switch, the stop register and the output register of each of the combination units 9, 10 and 11 depicted in FIG. 1. In the stop register, settable and resettable T flip-flops 44 which perform the toggle operation are provided corresponding to the stop switches 41 and the inputs of the ON-OFF detector 42 connected in parallel therewith. The stop register is adapted so that AND circuits ($A_1$ to $A_8$) 43 are controlled by a control pulse $SS_1$ ($SS_2$, $SS_3$) from the decoder and write control circuit 8 to preset the registration read out of the registration memory (52, 53). Further, the T flip-flops 44 are reset by a control pulse $SR_1$ ($SR_2$, $SR_3$) from the decoder and write control circuit 8. That is, in the present system, the ON and OFF states of each of the tone and effect tablets are indicated by "1" and "0", respectively, and the registrations are also indicated in the same manner. The stop registers depicted in FIG. 1 are each composed of the AND circuits ($A_1$ to $A_8$) 43 and the T flip-flops 44. The logical sum of each of the outputs from the T flip-flops 44 and each output from the crescendo registration memory 12 is provided by the corresponding one of OR cirucits ($O_1$ to $O_8$) 25 and is applied to the D terminal of the corresponding one of D type flip-flops 46. The output registers in FIG. 1 are each comprised of the OR circuits 45 and the D type flip-flops 46. The D type flip-flop 46 are each supplied at the clock terminal with the logical product of fundamental clock $\phi$ of the external system and the status flip-flop output $\overline{Q}$ from an AND circuit 47 to provide the output 1 (2 or 3) and the indicating unit output from the output Q. Accordingly, a change in the registration pattern is synchronized with the external system and, further, when the present system is in its second operative state, the registration immediately preceding it is stored. In the absence of the clock in the external system the master clock of the present system is applied as the clock $\phi$ to sequentially write the registrations in the output register.

Figure 5:
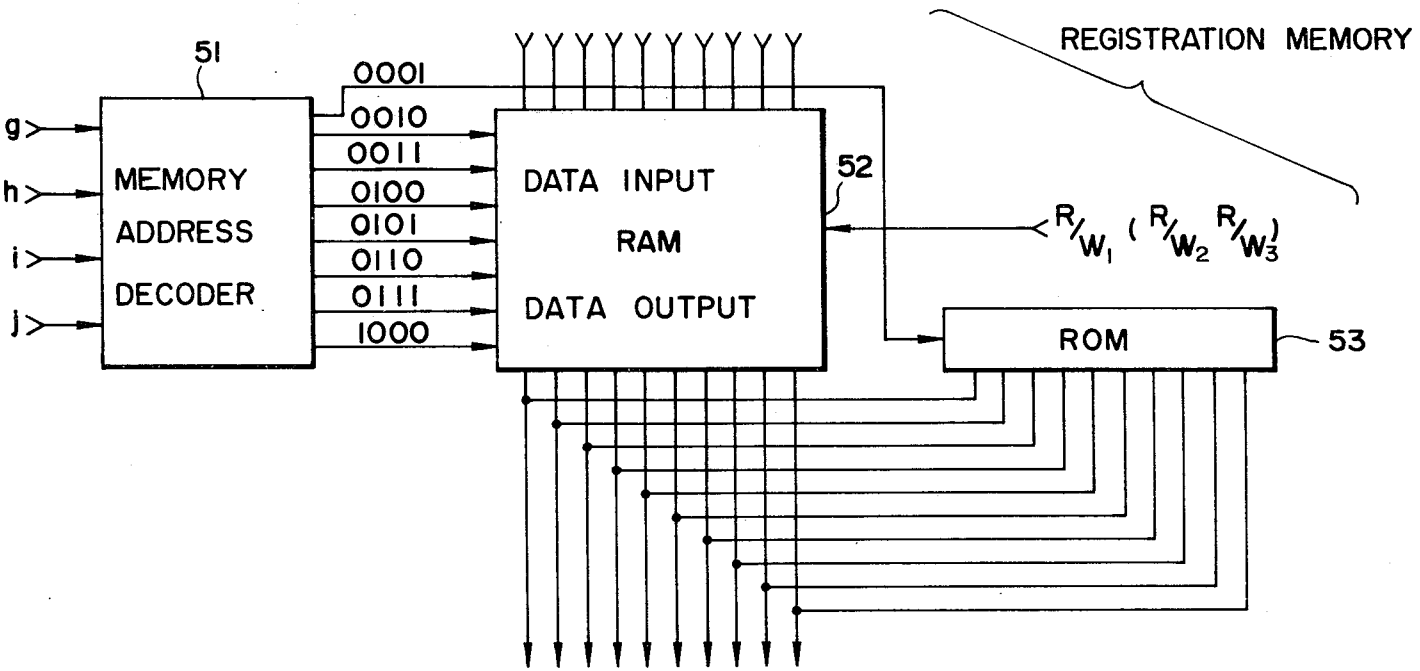
FIG. 5 shows details of the registration memory and the memory address decoder of each of the combination units.

FIG. 5 shows in detail the registration memory and the memory address decoder of each of the combination units 9, 10 and 11 depicted in FIG. 1. To the memory address decoder 51 are applied the four low-order bits as the registration memory address assignment codes (g, h, i, j) from the switch-ON detector and encoder 4. The addresses of the outputs from the memory address decoder 51 are assigned as exemplified in the following Table 2. That is, the general combinations and sub-combinations (swell, great and pedal) are assigned by the write signal $R/W_1$ ($R/W_2$, $R/W_3$) to a writable memory, i.e. a random access memory 52 and the full organ registration to a read-only memory 53.

Table 2

| Address | Combination Registration | |
|---|---|---|
| 0 0 0 1 | Full organ registration | |
| 0 0 1 0 | General combination | No. 1 |
| 0 0 1 1 | " | No. 2 |
| 0 1 0 0 | " | No. 3 |
| 0 1 0 1 | " | No. 4 |
| 0 1 1 0 | Sub-combination | No. 1 |
| 0 1 1 1 | " | No. 2 |
| 1 0 0 0 | " | No. 3 |

In the present system the abovesaid registration memory is provided for each of the swell, great and pedal keyboards.

Figure 6A:
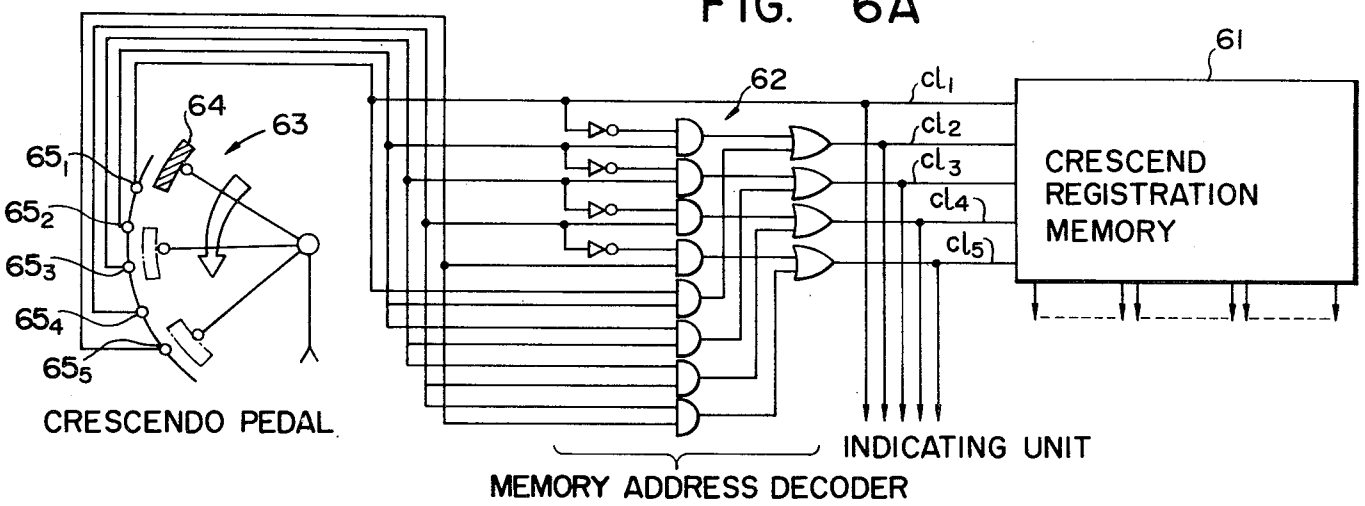
FIG. 6A shows details of the crescendo registration memory, the address decoder and the crescendo switch.

FIG. 6 illustrates in detail the crescendo registration memory 12, the address decoder 13 and the crescendo switch 14 used in the FIG. 1 embodiment. In FIG. 6A, a crescendo pedal 63 rotates a conductive piece 64 within the range of its rotational movement to sequentially interconnect two adjacent ones of terminals $65_1$ to $65_5$. In a memory address decoder 62, the input lines thereto from the terminals $65_1$ to $65_5$ are each branched into two, one being connected via an inverter to an OR circuit and the other being connected directly to the OR circuit. The outputs from the memory address decoder are applied to the indicating unit 15 to indicate the position of the crescendo pedal and, at the same time, are stored in a crescendo registration memory 61.

Figure 6B:
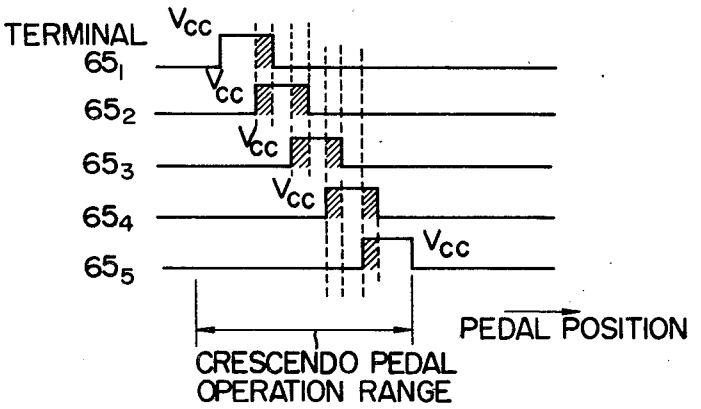
FIGS. 6B and 6C show graphs for a better understanding of the explanation of FIG. 6A.
Figure 6C:
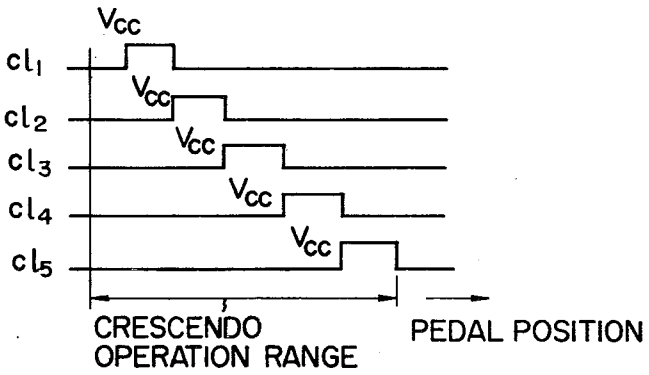

FIG. 6B shows the relationship between the outputs from the terminals $65_1$ to $65_5$ of the crescendo pedal 63 and its position. In the hatched parts in FIG. 6B, two adjacent ones of the terminals $65_1$ to $65_5$ simultaneously provide outputs. Accordingly, these outputs are converted by selected combinations of the gates of the memory address decoder 62 into such outputs $cl_1$ to $cl_5$ as depicted in FIG. 6C.

Figure 7A:
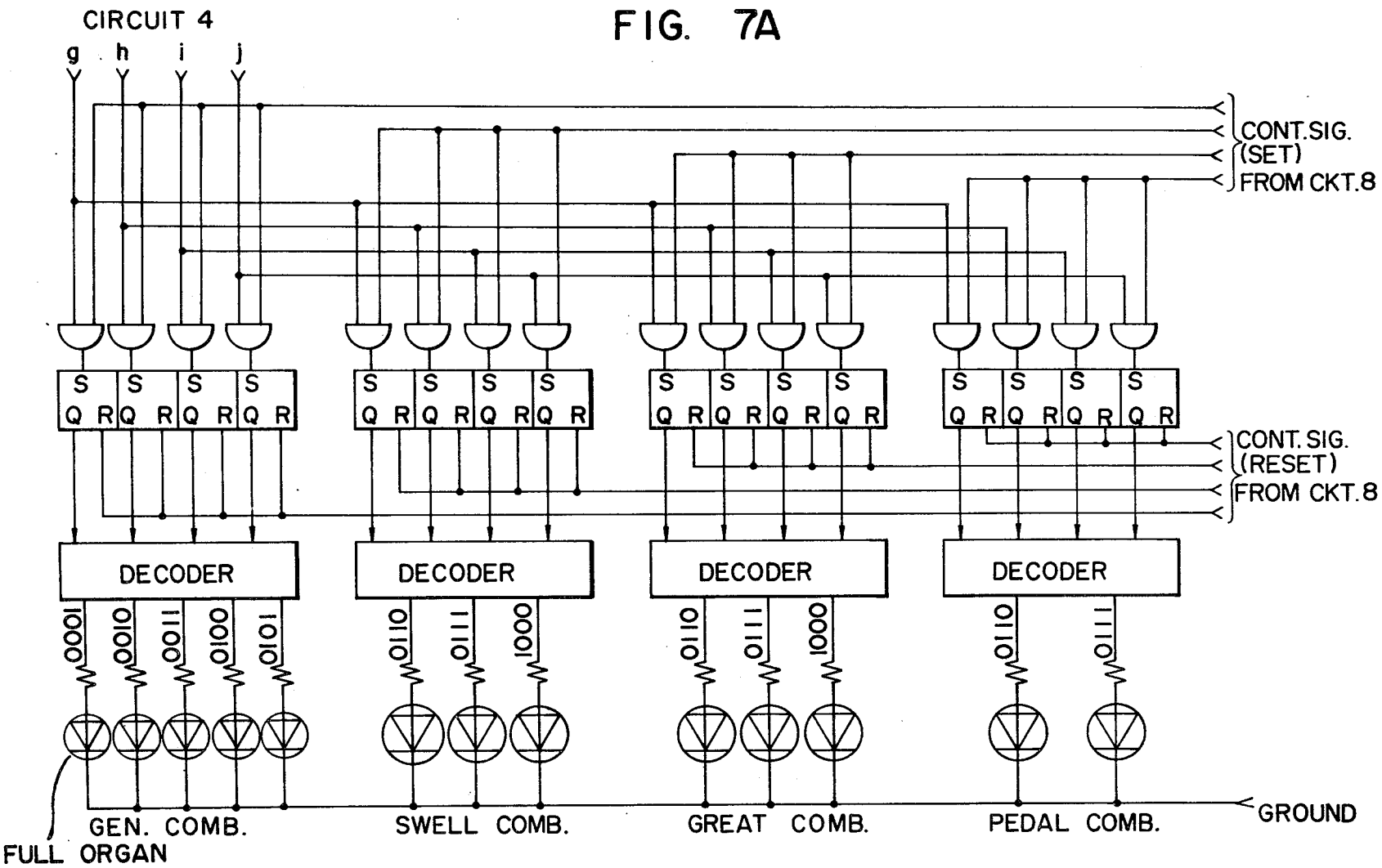
FIG. 7A shows details of a designated combination switch display.
Figure 7B:
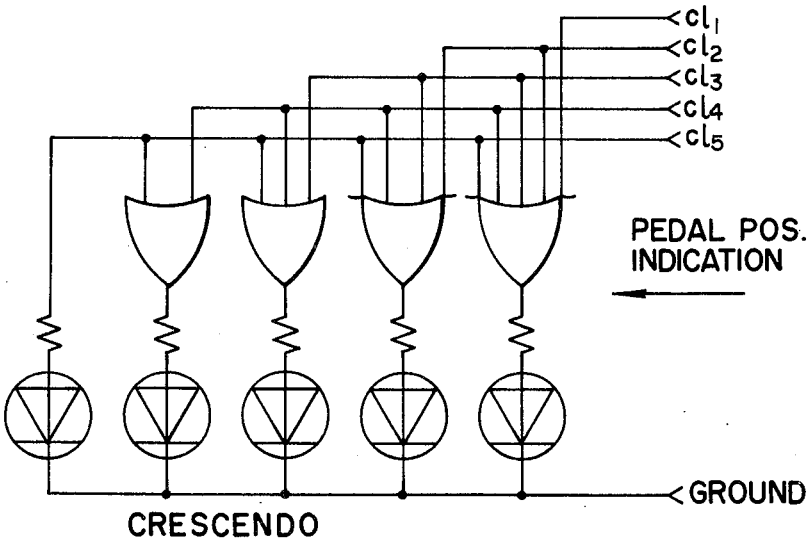
FIG. 7B shows details of a crescendo pedal position display.
Figure 7C:
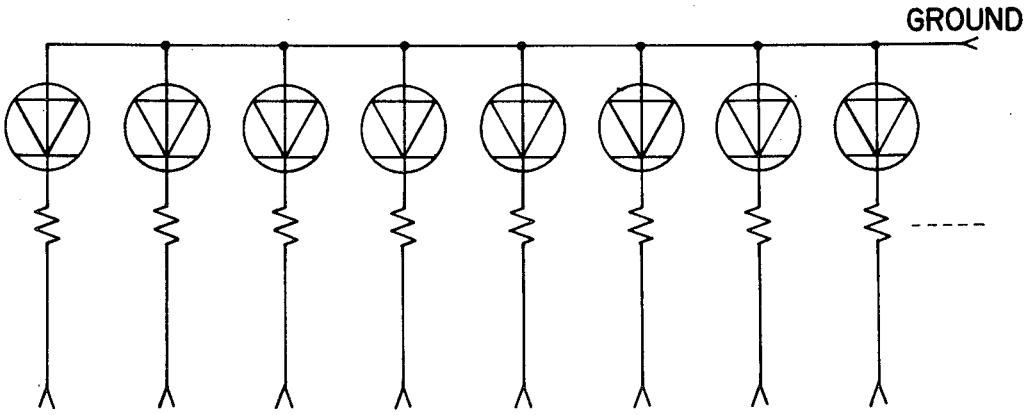
FIG. 7C shows a tablet ON-OFF display.

FIGS. 7A, 7B and 7C are detailed explanatory diagrams of the indicating unit 15 used in the FIG. 1 embodiment. FIG. 7A shows a designated combination switch display, FIG. 7B a crescendo pedal position display and FIG. 7C a tablet ON-OFF display.

The combination switch display of FIG. 7A is adapted such that the registration memory address assignment codes (g, h, i, j) from the switch-ON detector and encoder 4 and the control signal (set) from the decoder and write control circuit 8 are applied via AND circuits to the S terminals of RS flip-flops to set them and that the Q outputs from the RS flip-flops are applied to a decoder of each combination (general, swell, great and pedal) to light a luminescent diode (a lamp). Further, the control signal (reset) from the circuit 8 is applied to the R terminals of the RS flip-flops to reset them turning OFF the luminescent diode. In this manner, a lamp indication of the status of the registration address code can be provided by assigning the desired combination.

In FIG. 7B, the outputs $cl_1$ to $cl_5$ from the memory address decoder 62 shown in FIG. 6 are connected to luminescent diodes through OR circuits, respectively, and as the crescendo pedal is stepped, the number of luminescent diodes lighted increases one by one. Consequently, the number of luminescent diodes being lighted indicates the position of the crescendo pedal.

FIG. 7C shows means for merely indicating the ON-OFF state of the tone and effect tablets.

Figure 8A:
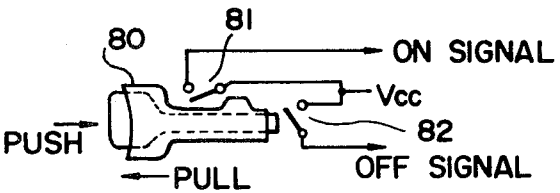
FIGS. 8A, 8B and 8C are explanatory of a stop register employing draw knobs as stope switches.
Figure 8B:
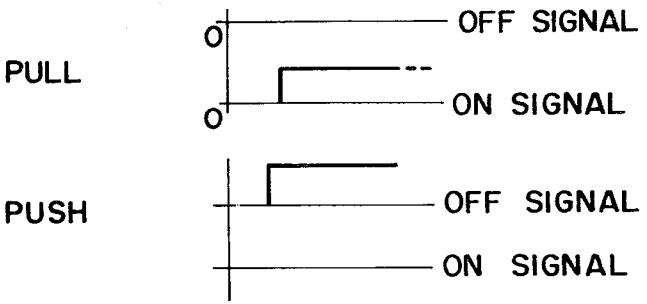
Figure 8C:
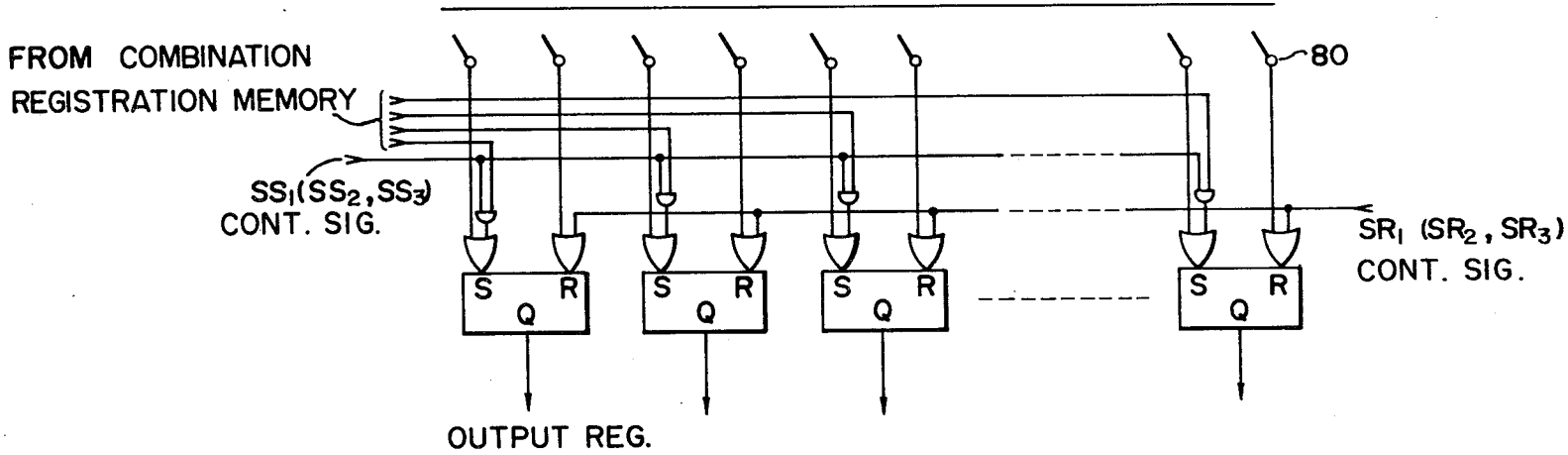

FIGS. 8A, 8B and 8C are explanatory of the case where a non-lock type draw knob is used as the stop switch, FIG. 8A showing its construction, FIG. 8B its characteristic and FIG. 8C the stop register employing such draw knobs. As illustrated in FIG. 8A, a draw knob 80 actuates ON and OFF contacts 81 and 82 with its side projection and its top end portion to provide an ON signal when pulled and an OFF signal when pushed. Accordingly, its characteristic is such as shown in FIG. 8B.

FIG. 8C illustrates an example of the circuit corresponding to the structure (43, 44) in FIG. 4 in the case of employing such draw knobs 80. The same function as that described above can be obtained by the use of RS flip-flops.

With the present invention, after detection of ON signals of actuation switches of combination units and a crescendo pedal, registration is read out by a registration memory composed of a random access memory and a read-only memory and control signals are read out by a read-only memory, whereby the states of the combination units and the ON-OFF state of stop switches are stored and indicated by means of lamps, as described above. In the present invention, the combination units and the crescendo pedal are almost fabricated as integrated circuits and mechanical parts are limited only to combination selecting switches and so forth. These switches are simplified by using known non-lock type switches in combination with lamp indication employing luminescent diodes responsive to the ON-OFF state of the switches, as described previously. Further, semiconductor memories such as read-only memories and randam access memories are employed as registration and control signal memories, by which many registrations can be preset. Accordingly, it is possible not only to satisfy the functions of conventional combination units and crescendo pedal but also to provide for increased functions by the use of LSIs without increasing the size of the device.

It will be apparent that many modifications and variations may be effected without departing from the scope of the novel concepts of this invention.

What is claimed is:

1. A performance supporting device for organs, comprising:

means for detecting ON signals of actuating switches of combination units to provide control code signals;

means for setting signals indicating the individual operative states of the switches by the switch-ON signals;

a first read-only memory having stored therein coded control signals necessary for presetting and selection of registrations and selectively reading out therefrom the coded control signals in response to the detected control code signals;

means for decoding the contents of the first read-only memory to produce control signals;

a registration memory composed of a writable memory capable of storing therein a plurality of registrations and a second read-only memory having stored therein registrations;

a first register supplied with a signal from a stop switch and reading out the registration memory in a predetermined operative state to store a registration pattern and the ON/OFF state of the stop switch, the first register having the function of changing its content by the stop switch for setting a desired registration pattern by the stop switch, the output of the first register being applied to the input of the writable memory for storing therein a plurality of registration patterns by a set of stop switches; and means for indicating the state of each of the combination units and the ON/OFF state of the stop switch.

2. A performance supporting device for organs according to claim 1, comprising combination units having acutating switches, and wherein the actuating switches of the combination units include a switch for designating a train of registrations, a switch for tuning OFF all of the stop switches and a switch for presetting the registration pattern set by the stop switch.

3. A performance supporting device for organs according to claim 1, wherein detecting the ON signals of the actuating switches of the combination units forms a first operation, and storing the train of registrations in the registration memory and reading out thereof the registrations forms a second operation, and wherein said first and second operations are achieved at different times.

4. A performance supporting device for organs according to claim 1, wherein the actuating switches and the stop switches are single-pole, non-locking type switches.

5. A performance supporting device for organs according to claim 1, wherein the indicating means comprises an electric display.

* * * * *